US007437986B2

(12) United States Patent
Fuss et al.

(10) Patent No.: US 7,437,986 B2
(45) Date of Patent: Oct. 21, 2008

(54) LANDMINE AVOIDANCE AND PROTECTION DEVICE

(75) Inventors: Franz Konstantin Fuss, Singapore (SG); Ming Adin Tan, Singapore (SG)

(73) Assignee: Nanyang Technological University, Singapore (SG)

( * ) Notice: Subject to any disclaimer, the term of this patent is extended or adjusted under 35 U.S.C. 154(b) by 510 days.

(21) Appl. No.: 11/212,120

(22) Filed: Aug. 25, 2005

(65) Prior Publication Data

US 2007/0044645 A1 Mar. 1, 2007

(51) Int. Cl.
*F41H 11/12* (2006.01)

(52) U.S. Cl. ..... 89/1.13; 102/402

(58) Field of Classification Search ..... 89/1.13; 102/402, 403

See application file for complete search history.

(56) References Cited

U.S. PATENT DOCUMENTS

| | | | |
|---|---|---|---|
| 4,611,411 | A | 9/1986 | Ringler et al. |
| 5,926,977 | A | 7/1999 | Sanders |
| 5,979,081 | A | 11/1999 | Vaz |
| 5,992,056 | A | 11/1999 | Lohrmann |
| 6,006,646 | A | 12/1999 | Makris et al. |
| 6,505,421 | B1 | 1/2003 | Vaz |
| 6,621,418 | B1 | 9/2003 | Cayrol |
| 6,655,051 | B1 | 12/2003 | Peche et al. |
| 6,725,572 | B1 | 4/2004 | Krstic |
| 6,751,892 | B2 | 6/2004 | Chavet et al. |
| 6,952,990 | B1 * | 10/2005 | Clodfelter ..... 89/1.13 |

FOREIGN PATENT DOCUMENTS

| | | |
|---|---|---|
| DE | 4402465 | 3/1995 |
| SE | 470498 | 6/1994 |
| WO | WO03037125 | 5/2003 |

(Continued)

OTHER PUBLICATIONS

Robert M. Harris et al., "vol. II Final Report of the Lower Extremity Assessment Program (LEAP 99-2)—Report No. ATC—8199", Aug. 2000. U.S. Army Institute of Surgical Research, Extremity Trauma Study Brach, Fort Sam Houston, Texas. www.humanitarian-demeining.org/demining/pubs/protection.asp, 42 pages.

(Continued)

*Primary Examiner*—Stephen M Johnson
(74) *Attorney, Agent, or Firm*—Dinsmore & Shohl LLP

(57) ABSTRACT

A mine avoidance and protection device has a frame adapted to be secured to a source of a load, such as the foot of a person. Attached to the frame are at least three support legs each extending from the frame. Each leg has a releasable joint between the leg and the frame. At least one detector is operable to provide a detection capability for each support leg, operable to detect a characteristic of a mine when at least a portion of the support leg is located proximate to the mine. An actuator operable to provide an actuation capability at the joint of each leg, to: constrain the joint to allow a load to be transmitted from the frame, through the joint and the support to the terrain. The actuator can also release the joint such that a load can not be transmitted from the frame through the joint. The joint between the plate and each leg may be a one degree-of-freedom prismatic joint or revolute joint.

25 Claims, 13 Drawing Sheets

FOREIGN PATENT DOCUMENTS

WO WO03101234 12/2003

OTHER PUBLICATIONS

D.M. Bergeron and C. Chichester, (2003) "Protecting Deminers From APLs: A Review of U.S./Canada Cooperation in R&D", Journal of Mine Action,7.1, 18 pages Sep. 9, 2005.

Aigis Engineering Solutions. Available: http://www.aigis.co.uk, Nov. 8, 2005; 1 page.

Wellco Enterprises. Available: http://www.wellco.com/html/blast_protective_boot.html, Sep. 9, 2005; 1 page.

Kejo Ltd. Company. Available: http://bodyarmour.safeshopper.com/79/852.htm?735, no date; 2 pages.

* cited by examiner

LANDMINE AVOIDANCE AND PROTECTION DEVICE

FIELD OF THE INVENTION

The invention relates to landmine avoidance and protection devices, including landmine avoidance and protection footgear.

BACKGROUND OF THE INVENTION

Mines are devices, which are designed to explode when they are either touched by, or come into close proximity with, an object, such as a vehicle or human beings, causing damage to the object. Landmines are mines which are situated in or on ground terrain. Anti-personnel (AP) landmines are landmines that are specifically designed to harm human beings who are walking or otherwise moving across ground terrain. Mines targeted primarily at vehicles like tanks and troop carriers typically have a diameter in the range of about 20-40 cm. AP mines are typically smaller having for example, a diameter in the range of about 4.5-15 cm. AP mines are often deployed over a large area and are usually buried in the ground or otherwise camouflaged.

The clearing of existing minefields requires special protection for professional de-miners. Common mine injuries include loss of limbs, wounds due to fragmentation devices, and severe injuries to hands, arms, faces, and heads. The latter injuries usually occur when handling a mine, specifically during de-mining. Most accidents and injuries occur during excavation and due to missed mines (See for example: Bergeron D M and Chichester C (2003) Protecting Deminers From APLs: A Review of U.S./Canada Cooperation in R&D. Journal of Mine Action 7.1)

One way of protecting persons, particularly professional de-miners, is to provide some kind of protective footgear that a person can wear when they are in an area known to possibly have mines in the ground. There are basically two types of known protective foot gear: (a) footgear which attempts to provide some shielding action to try to minimise injuries when a mine explodes underfoot; and (b) footgear which is designed to minimise the prospect of mine detonation.

Types of known footgear in the latter category include: (1) air cushion shoes, which distribute the ground reaction force over a large area and thus reduce the pressure applied to a mine (U.S. Pat. No. 4,611,411 to Ringler et al.; U.S. Pat. No. 6,751,892 to Chavet et al.); and (2) metal detector shoes that employ a muscle stimulation effect, such that any metal contact causes an electric impulse to stimulate a muscle, usually a leg muscle, which when stimulated is activated and moves the leg off and away from the mine (U.S. Pat. No. 6,621,418 to Cayrol).

However, the known systems all suffer from significant defects or drawbacks. For example, detonation provoking mine shoes (See U.S. Pat. No. 5,926,977 to Sanders; U.S. Pat. No. 5,979,081 to Vaz; U.S. Pat. No. 5,992,056 to Lohrmann; U.S. Pat. No. 6,006,646 to Makris et al.; U.S. Pat. No. 6,505,421 to Vaz; U.S. Pat. No. 6,655,051 to Peche et al.; U.S. Pat. No. 6,725,572 to Krstic; Patent document SE470498 dated June. 1994 to Bramsell; Patent document DE4402465, dated March. 1995 to Rösner et al.; Patent document no. CN1265464 to Li et al.; PCT document WO03037125 dated May 2003 to Zeman et al.; PCT document WO03101234 dated December 2003 to Joynt et al.; Aigis Engineering Solutions. Available: http://www.aigis.co.uk/; Wellco. Available: http://www.wellco.com/html/blast_protective_boot.html; Kejo Ltd Company. Available: http://bodyarmour.safeshopper.com/79/852.htm?735) are generally damaged and destroyed on explosion of a mine. Hence they are for single use and leave the wearer without appropriate foot gear in the middle of a minefield. Moreover, test results (LEAP 99-2 report: Volume II-Final Report of the Lower Extremity Assessment Program (LEAP 99-2), August 2000 (U.S. Army Communications—Electronics Command, Night Vision Electronic Sensors Directorate, U.S. Army Institute of Surgical Research Extremity, Trauma Study Branch U.S. Army Aberdeen Test Center, U.S. Army Soldier Systems Command). Available: http://www.humanitarian-demining.org/demining/pubs/protection/leap99-2/leap99 2_report_vol 2.asp)) of different mine shoes clearly show, that a person will still at least suffer from broken foot bones, which do not allow the injured person to walk and to leave the mine field without assistance. Most tests (LEAP 99-2 report), however, resulted in injuries, which require treatment such as by amputation (below-knee and above-knee amputations), despite being equipped with blast protection shoes.

So-called detonation preventing air cushion shoes will often not distribute the load sufficiently to reliably avoid a detonation. On uneven ground like woodland, forested lands, and rocky terrain, air cushion shoes can generally not be employed. Furthermore, walking is difficult with such large air cushions on a person's feet. Additionally, puncturing of the cushions causing leakage and loss of air, is a problem, even if the shoe consists of two independent air cushion layers.

Detonation preventing footgear employing muscle stimulating devices also have significant drawbacks. The muscle stimulating devices bypass the normal physiological innervation (nervous supply) of a muscle, and activate the muscle by an electric impulse. Consequently, the central nervous system loses control over the muscle, and the external stimulation results into uncoordinated movements, creates a danger of falling (possibly on the mine), and results in a disturbance to the person's concentration due to the electric shock which activates the muscle.

Accordingly, an improved mine avoidance and protection device is desired.

SUMMARY

It is therefore desirable that footgear used to avoid and protect against mines: (a) not exert a force on a mine when coming into close proximity with it, and thereby not otherwise detonate the mine; (b) prevent any injuries to the wearer; and (c) not interfere with the wearer's gait, movements, or concentration.

It should be noted that the use herein of the phrase "in close proximity", includes being in contact.

According to one aspect of the invention there is provided a device comprising: a frame adapted to be secured to a source of a load and at least three support legs each extending from the frame for supporting the frame in spaced relation to a terrain. Each said leg has a releasable joint between the leg and the frame. At least one detector is operable to provide a detection capability for each support leg. Each detection capability is operable to detect a characteristic of a mine when at least a portion of the support leg is located proximate to the mine. At least one actuator is operable to provide an actuation capability at the joint of each leg, and is operable to: (a) constrain the joint to allow a load to be transmitted from the frame, through the joint and the support leg to the terrain; and (b) to release the joint such that a load can not be transmitted from the frame through the joint and the support leg to the terrain. The at least one actuator is operable in response to a signal received from the at least one detector indicating the detection of the characteristic at a first leg of the support legs, to release each joint associated with the first support leg. The at least one detector is in communication with the at least one actuator device, so as to be able to provide the signal from the at least one detector associated with each detection capability to the at least one actuator associated with the corresponding actuation capability. When the characteristic is detected proximate to a support leg, the at least one detector communicates with the at least one actuator to cause the actuator to release the constraint at the joint associated with that support leg.

According to another aspect of the invention there is provided a device comprising a plate having a lower surface area and adapted to be secured to an appendage of a human being. The device also comprises at least three support legs each extending below the lower surface of the plate, for supporting the plate on terrain, each leg having a distal end for engaging the terrain. Each leg is movable in at least one degree of freedom relative to the plate at a joint when a ground reaction force is applied to the leg when said joint is not constrained. A detector system provides a detection capability associated with each leg, the detection capability for detecting a characteristic of a mine when at least a portion of the leg is located proximate to the mine. An actuator associated with each leg is operable to release the leg portion to allow movement in the at least one degree of freedom such that no load can be transmitted from the plate through the joint and the leg to the terrain. Each actuator is operable in response to a signal received from the detection system associated with each leg. The detection associated with each leg, is in communication with the actuator device associated with the respective leg and is operable to activate the actuator. When the characteristic is detected by the detector, the detector system communicates with the actuator to cause the actuator to release the constraint and to allow the leg to move at the joint, with respect to the plate once the characteristic is detected by the detector, such that the leg exerts a zero-force on an object.

According to another aspect of the invention there is provided a method of avoiding the activation of a mine comprising: supporting a load with at least three support legs each in a constrained mode, each leg having a constrained mode wherein the support leg participates in supporting the load on the terrain, and an unconstrained mode, wherein the leg does not participate in supporting the load on the terrain. The method also comprises detecting a characteristic of a mine when at least a portion of one of the three support legs is located proximate to the mine; and in response to said detecting, sending a signal to an actuator; in response to the signal, transferring the one leg from the constrained mode to the unconstrained mode with the actuator such the one leg no longer participates in supporting the load on the terrain.

According to another aspect of the invention there is provided a device comprising a base for supporting a load with at least three support legs secured to the base. Each leg has a constrained mode wherein the support leg participates in supporting the load on the terrain, and an unconstrained mode, wherein the leg does not participate in supporting the load on the terrain. A detector system having a capability associated with each support leg for detecting a characteristic of a mine when at least a portion the respective support legs is located proximate to said mine. The device also comprises an actuation system having a capability associated with each support leg for transferring each support leg independently or the other support legs, from a constrained mode to an unconstrained mode; and a communication system operable to send a signal to the actuation system in response to the detection of the characteristic. The actuation system, in response to receiving the signal from the communication system in relation to the detection of the characteristic in association with one of the three support legs transfers the one leg from the constrained mode to the unconstrained mode such that the one leg no longer participates in supporting the load on the terrain.

By way of summary of some example embodiments, landmine protection devices, and in particular footgear, which prevent the explosion of AP mines when stepping on them, can consist of a plate to be attached to, or serve as the sole of a shoe or boot. The footgear can have at least three support legs mounted to and extending below the plate to support the plate on the ground. The legs, which are in contact with the ground, are connected to the plate by a joint having at least one degree of freedom. This degree of freedom is selected so that when the joint is released, a force exerted by the ground on the leg can not be resisted and thus no load can be transmitted from the plate to the ground through that support leg. All loads from the plate will then be transmitted to the ground through the remaining support legs.

A detection capability can be provided for each support leg. This can be provided by a detector, such as a metal detector, for each support leg. The detector is operable to detect a characteristic of a mine such as the presence of a metal material. An actuation capability can be provided for each leg. An actuator may be provided between the plate and each support leg. The actuator can be operable to constrain the motion of the leg (ie. will allow loads to be transmitted from the plate through the support leg to the ground) to assist in supporting the plate when that leg is not in close proximity to a mine. However, when the support leg is in close proximity with a detected object, the actuator releases the motion constraint to allow motion of the support leg at the joint (ie. provide a joint that can not transfer load from the plate to the ground). Thus the force between leg and mine is minimal, as the force of the unconstrained leg cannot be higher than that which results from the weight of each leg itself. This load is far below design trigger load of any landmine and consequently should not activate the landmine. Once the leg moves away from the mine such that the detector does not detect it anymore, the leg is returned to its initial position, such as through its own weight. The actuator is also deactivated, which restores the original constraint and locks the leg again in its original load carrying position. In that condition, the leg can again be loaded and transmits load from the plate to the ground.

The landmine protection avoidance device (detonation preventing mine shoe) can function like an artificial reflex loop, consisting of a sensor (e.g. a metal detector) in each leg, a feed-forward loop (electrical circuit), and an actuator, which in response to signals (and/or lack thereof) constrains and then releases the constraint on the leg, depending on whether the leg is in close proximity with a landmine.

The device may be provided with six separate, spaced support legs. The joint between the plate and each leg may be a one degree-of-freedom prismatic joint or a one degree-of-freedom revolute joint. Other joints can also be employed. The actuator between the plate and each support leg may be a linear actuator (e.g., solenoid) or a revolute actuator (e.g., electric motor). If the leg is connected to the plate by a prismatic joint, then the actuator, which constitutes and controls a motion constraint associated with the joint, provides a counter-force to the ground reaction force applied axially to the leg. If the leg is connected to the plate by a revolute joint, then the actuator which constitutes and controls a motion constraint associated with the joint provides a counter-moment about the joint, to the moment produced about the joint by the ground reaction force applied to the support leg.

In addition to merely releasing the support leg so that no load can be transmitted through the joint from the plate to the ground, the actuation mechanism for each leg may be operable to actively drive the leg away from a supporting position, when the leg comes into close proximity to a mine.

The actuator preferably is a unidirectional one, e.g., a solenoid with a sliding core. The latter is retracted actively once one of the legs of the mine shoe comes into contact with a metallic object, but returns into its original position passively through a spring. A bi-directional actuator, i.e., an active return of the core, is not advisable, as the actively returning core might lead to interference with the returning leg, and might even prevent the leg from returning and being locked properly.

The number of support legs is a design consideration, as an unconstrained leg reduces the support area of the shoe. If the number of the legs is too few, then the device becomes unstable upon one of the legs being deactivated.

In an embodiment with more than three legs, such as six legs, on even, flat terrain, all legs are in contact with the terrain and support the load transmitted from the plate. On uneven terrain, at least three legs will be in contact with the terrain. If a mine characteristic is detected by one of these 3 legs, then this leg is disabled. In this case, the next adjacent leg comes in contact with the ground and this very leg is in a position away from the metal object.

While the present invention is focused on minimising the prospect of mine detonation, the invention can additionally incorporate known features which are directed to providing some shielding action to try to minimise injuries if for some reason, a mine does explode.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

Figure 1A:
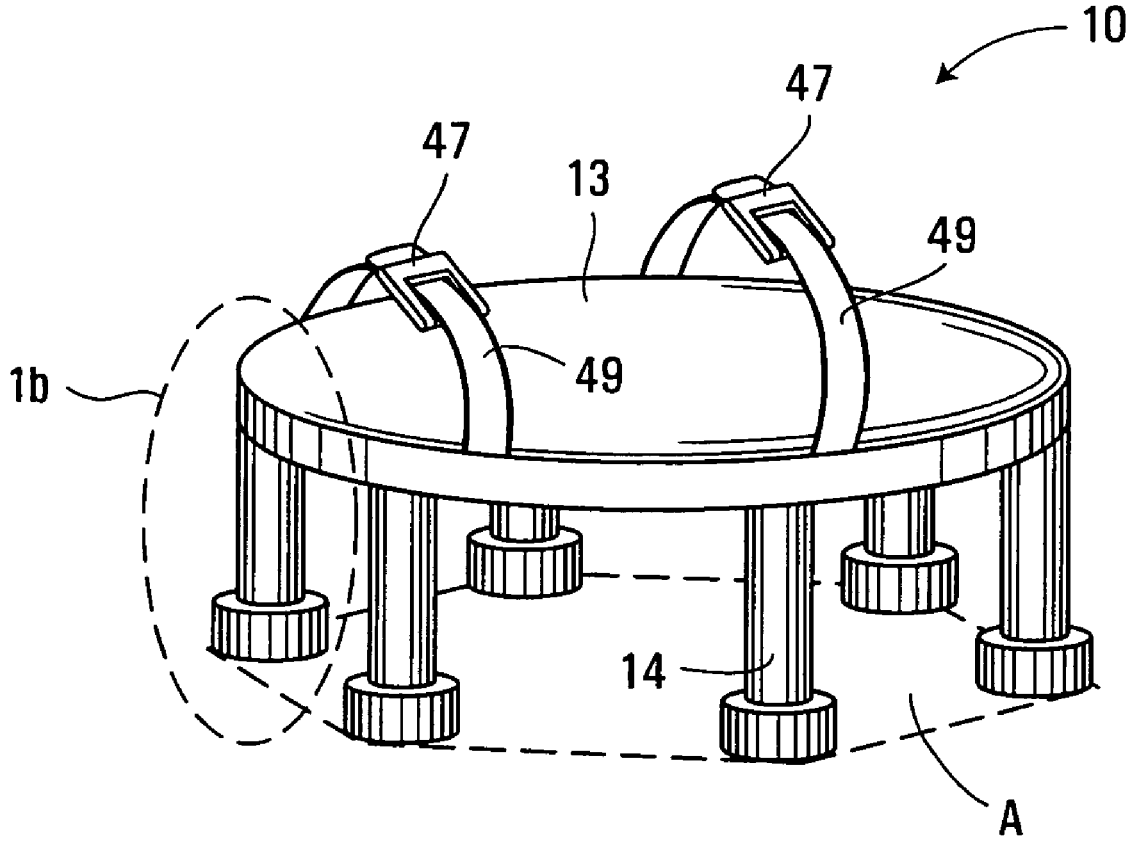
FIG. 1*a* is a perspective view of a mine shoe in accordance with an embodiment of the invention.

With reference first to FIG. 1*a*, a mine protection and avoidance device generally designated 10 includes a frame which can be in the form of a plate 13, support legs 14 and straps 49. The plate 13 can be a wide variety of shapes but serves as a supporting plate for support legs and is suitable for being secured directly or indirectly to an appendage, normally a foot, of a person. A plate could also be configured to be securable to a part of a mechanical or robotic device. In other embodiments the support legs might be directly connected to a load source or to a frame other than a plate. The plate 13 can be formed of any material that is capable of satisfying the load bearing requirements, but may be made of a material which would provide some significant level of protection should a mine explode underneath the plate 13. Suitable materials include but are not limited to steel, kevlar and other metals such as by way of example only, aluminium.

Plate 13 may be constructed with an outer housing enclosing an inner hollow cavity (not shown). The cavity can be used to house certain components of the mine shoe such as the electrical circuits, which can be employed to facilitate the operation of the device, as described below, and/or additional/supplementary power sources such as piezoelectric materials activated by the force transmitted through the plate, or mechanical systems (pneumatic systems, or mechanisms) which drive a dynamo.

The support legs 14 can be manufactured of a material chosen to avoid any interference with the detector. For example, if the detector is a metal detector, the legs 14 can be formed from a non-metallic material such as a plastic. The legs can also be formed generally as hollow tubes or cylinders, made of plastic/polymers. The weight of each such leg 14 would be minimal. Other configurations and material selections for legs 14 are possible.

The overall footprint size provided by the contact of legs 14 with the ground, can be chosen to be sufficiently large, and the position of the legs on that footprint can be chosen, so that the legs will be spaced sufficiently far apart so that multiple legs will not be deactivated at the same time, when a mine is detected, as will be explained in further detail hereinafter. By way of example only, with respect to AP mines of a diameter of about 15 cm, a typical size of a plate will be such that the legs circumscribe a support area A of at least about 1250 sq. cm and the device would be provided with a minimum spacing of the legs typically of about 16 cm (ie. the distance between outer edges of the ground plates or pads which contact the ground).

Figure 8:
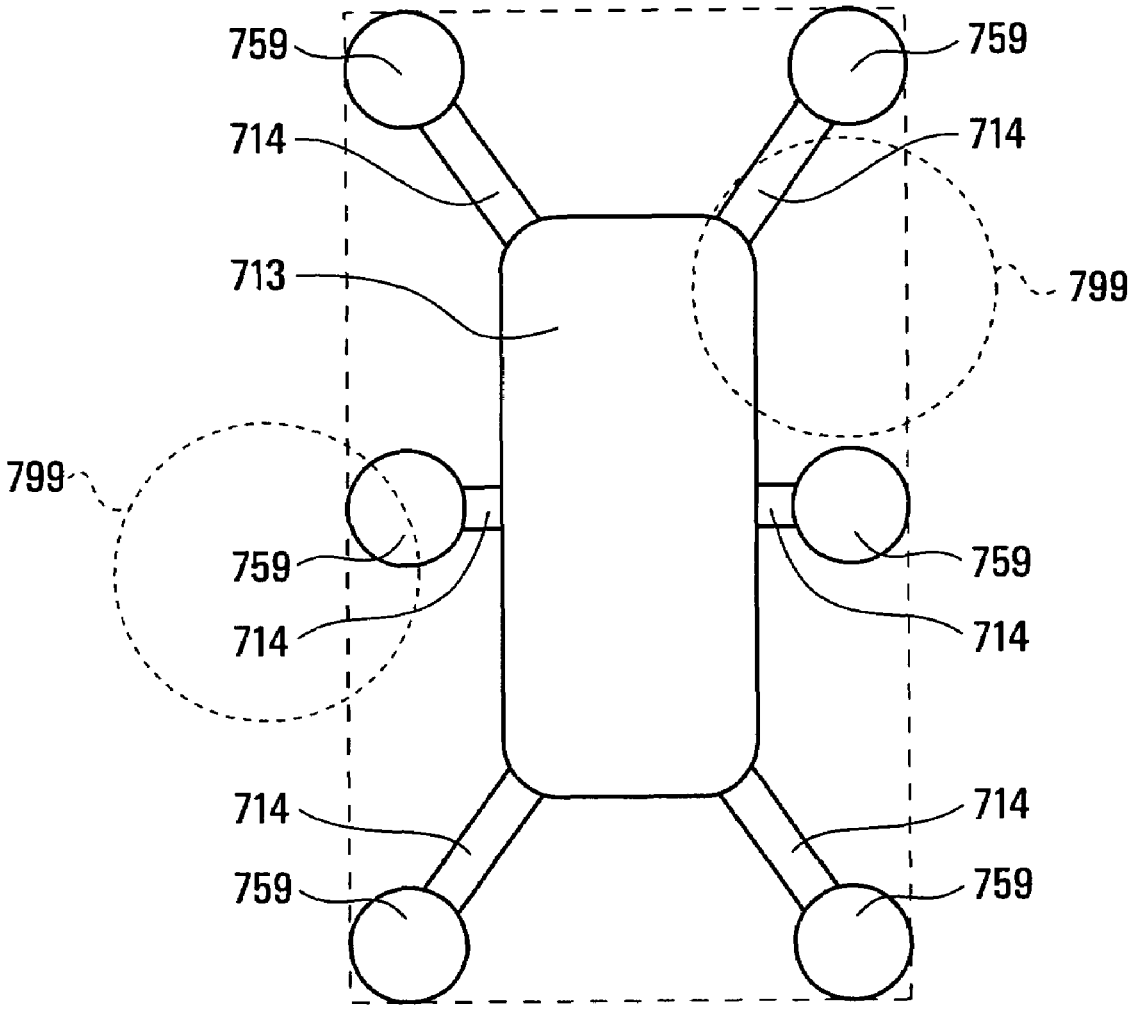
FIG. 8 shows the footprint of a device in accordance with an example embodiment of the invention, with example mine positions illustrated therein.

With reference to FIG. 8, the certain features of a generally rectangular footprint can be estimated for an example embodiment as follows:

Given an even number of legs, with the legs arranged in 2 rows (right and left row, or medial and lateral row)—for example, specifically 6 legs 714.

Calculation of minimum size of ground plate 759 of each leg 714: maximal foot pressure during medium speed walking at heel and $1^{st}$ metatarsal head: ~0.5 Mpa—this is the maximum desired pressure that it is desired for each foot to transmit to the ground.

The allowed ground reaction force at maximal pressure=1.2 BW. An estimate of the body mass+equipment is about 100 kg. 1.2 BW=1200 N.

The area and diamater to be required of one ground plate 759 under the assumption that only one plate comes into contact with the ground first, and is loaded maximally: area=1200 N/0.5 MPa=24 sq cm; therefore diameter ~5.5 cm.

To ensure the sensing area is greater than the ground plate or pad area 759, one can provide a sensor area for the detector preferably with a sensing diameter of 6 cm (this should be higher than the diameter of the ground plate which contacts the ground). The sensor areas can then be arranged at a distance of 15 cm apart, in order to prevent a 15 cm mine from activating 2 legs at the same time (ie. ground plate areas 16 cm apart).

Length of the footprint: [(3×5.5 cm)+(2×15.5 cm)] OR (5.75+15+6+15+5.75)=47.5 cm Width of footprint: [(2×5.5)+15.5] OR (5.75+15+5.75)=26.5 cm Therefore, the minimal area for the footprint can be estimated as $(26.5\times47.5)-[(5.5^2-2.75^2)\times\pi]\sim1250$ sq cm.

Of course other configurations can be provided to accommodate different sized landmines.

Returning to the device 10 as depicted in FIG. 1, straps 49 have ends secured to opposite sides of plate 13 and can be adjusted with buckles 47 to securely attach the device 20 for example to the foot of a person. Typically a person would wear a device as a mine shoe 10 on each foot. A device 10 could also be adapted to be attached to a person's hands (ie a mine glove). Thus with mine shoes/gloves attached to both hands and both feet, a person could move about a potentially mined area supported by both hands and feet.

As an alternative to straps 49, other attachment mechanisms can be employed such that mine shoe 10 can be secured to the feet or other footgear of a person. Some other examples of other attachment mechanisms include but are not limited to velcro and providing the device as part of an over-boot. In the case of the device being secured to a robot or other mechanical device, the device 10 could be bolted, welded or otherwise secured to the robot/mechanical device.

Figure 1B:
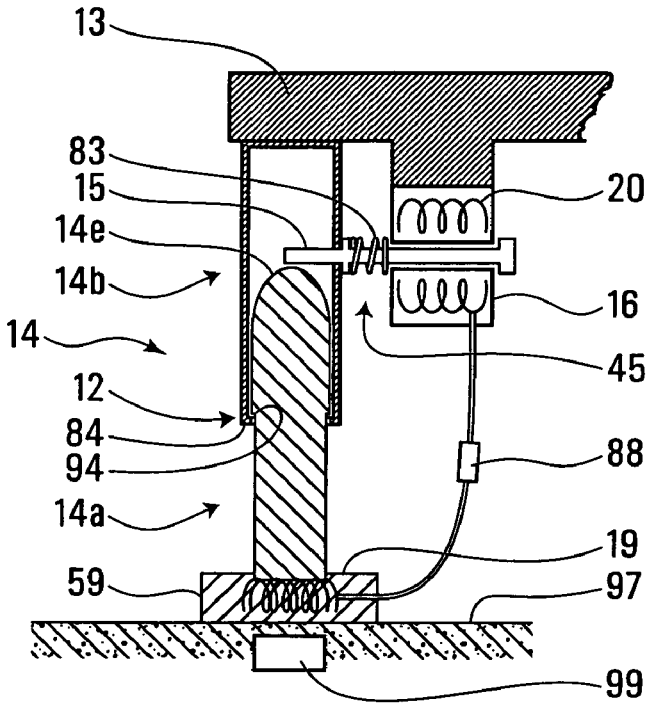
FIG. 1*b* is a cross-sectional side-view and cross-section of a part of a mine shoe in accordance with an embodiment of the invention.

With reference now to FIG. 1*b*, a mine shoe portion (identified as 1*b* in FIG. 1*b*) is shown in a cross sectional side view. In FIG. 1*b*, a support leg 14 is shown to have a prismatic joint mechanism 12 whereby a lower end portion 14*a* is capable of linear motion with respect to an upper support sleeve portion 14*b*. The support legs 14 of the mine shoe 10 are movable with respect to the plate 13, when the movement is unconstrained by an actuator such as actuator 45. Linear motion along the longitudinal axis of each leg 14 can occur at each of the joints between the legs 14 and the plate 13. However, this motion is normally constrained by an actuator 45. When the joint is constrained, the legs 14 can transmit loads from the plate 13 to the ground 97 through the joint 12. These forces will, in normal circumstances, not result in any motion at the joints, as the motion of the legs is normally constrained when the presence of a mine has not been detected.

Support sleeve 14*b* is preferably a hollow cylinder in cross section and has an upper distal end mounted to a lower surface of plate 13. The upper distal end can be secured to the plate using any conventional technique such as with bolts, welding etc. The upper portion 14*b* can be made of a heavier material than lower portion 14*a*, since the weight of upper portion 14*b*, will not be exerted on the ground 97 when the joint 12 is released, as described below.

Lower support leg portion 14*a* has an upper end that is received and slidable within the hollow cylinder 14*b*. In other embodiments, the lower support leg portion 14*b* or the entire support leg 14, may be movable partially or entirely into an aperture in the lower surface of plate 3.

When an upwardly directed ground reaction force is applied to the bottom distal end of lower leg portion 14*a*, the upward motion of the lower leg portion 14*a* within cylinder 14*b* is constrained by actuator 45. In FIG. 1*b*, actuator 45 includes a core (follower) 15 of a solenoid 16 mounted to the plate 13. The solenoid can be mounted to the plate in any known way. The follower 15 can be received through an aperture in the cylinder wall of upper portion 14*b* and thus be in direct contact with the distal end of lower leg portion 14*a*. This constrains any upward translation (arrow) of the lower leg portion 14*a* relative to upper portion 14*b* and plate 13, and permits loads to be transferred axially from plate 13, down through leg 14 to the ground 97.

Motion downwards of the lower leg portion 14*a* (under for example the influence of gravity), relative to upper portion 14*b* can be limited by the interaction of an inwardly extending annular lip 84 of upper portion 14*b*, with an outwardly extending annular ledge 94 of lower portion 14*a*.

A detection system provides a detection capability for each support leg 14. Each support leg can have directly mounted thereto, a separate detector 19, which may be located within a cavity of a hollow leg support pad 59. The support pad can be connected to or integrally formed with lower leg portion 14*a*, which supports the leg 14 on the terrain (e.g. ground surface 97). The pad 59 may be rigidly connected to leg 14 or be provided some degree of movement relative to the leg 14. For example, the pad may be mounted for resilient displacement from a generally level position. As an aside, while it is contemplated that such a device 10 will be used outdoors on ground terrain, a device could be used on other terrain surfaces.

Detector 19 may be a metal detector device. Some types of known metal detectors make use of the ability of metal materials to reflect certain electromagnetic waves. Such devices typically comprise an electromagnetic wave transmitter and an electromagnetic wave receiver capable of detecting reflected electromagnetic waves sent out by the transmitter. Known metal detectors employ technologies such as Very Low Frequency (VLF) technology, which through phase shifting enables the detector to discriminate between for example, different metal materials or specific types of objects. Other technologies used in known metal detectors include but are not limited to pulse induction and beat-frequency oscillation. Examples of commercially available metal detectors that could be employed in device 10, include devices that are made by Tesoro Electronics, Inc. (see http://www.tesoro.com/); Accurate Locators Inc. (see http://www.accuratelocators.com/); Viking Metal Detectors (see http://www.metaldetectors.co.uk/); Troy Custom Detectors Inc. (see http://www.troycustomdetectors.com/); and Finnell Enterprises (see http://www.metallocators.com/).

Other detectors might also be employed which detect another characteristic of an object that suggests the possible presence of a mine. This may be important because some mines have very little metal material in them and may have a large amount of plastic material. For example, detectors which might be suitable to be employed include but are not limited to detectors which detect magnetic radiation, visible or invisible light or infra-red, sound waves, ground penetrating and micropower impulse radar, thermal images, the presence of chemical reactions or chemicals such as traces of explosives, and the presence of nuclear radiation.

It will be appreciated that if each of support legs 14 has a separate detection capability associated therewith, the presence of a mine in the close proximity of each leg can be identified. With separate detection capability, each support leg can function independently of the others. It may be possible however to have a single detection device/system, which can operate to provide separate detection capability isolated for each support leg 14.

Additionally, the detection system may be able to detect the presence of more than one characteristic of a mine. Thus the system might for example detect the presence of particular types of metals and also the presence of certain chemicals. By looking for the presence of more than one characteristic associated with a mine, the chances of the detection system of falsely detecting the presence of might be reduced. Alternatively the detection system might look for the presence of any of two or more characteristics to provide a wider detection capability, such as the two characteristics of a metal and a chemical associated with an explosive material.

Figure 3:
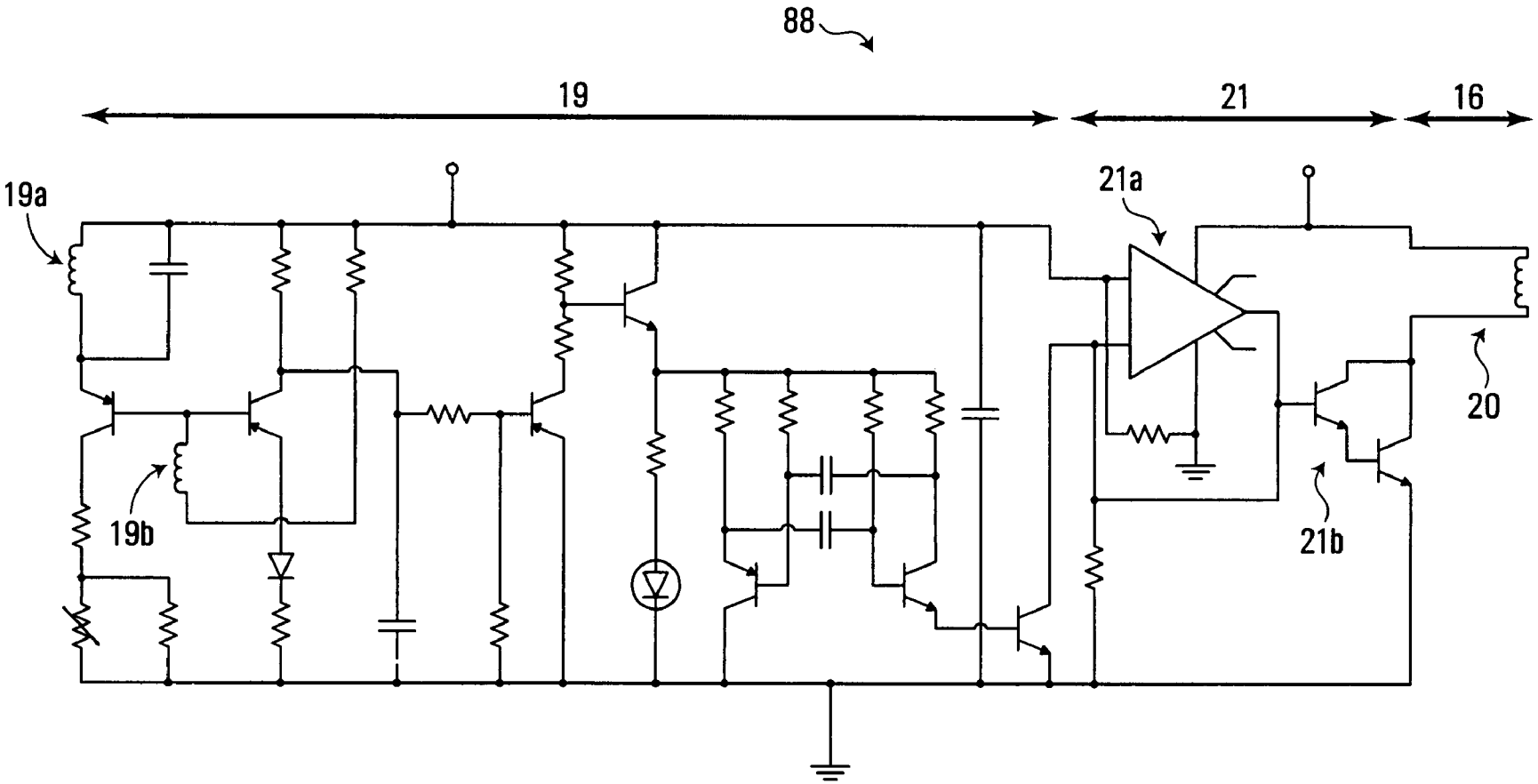
FIG. 3 shows an example of an electrical circuit that can be employed in the embodiments of FIG. 1*b* or 1*c;*

The detector 19 associated with each support leg 14 is in communication with an actuation system. The actuation system may have separate actuator 45 associated with each leg 14. This communication may be facilitated by electrical circuitry such as is illustrated in FIG. 3. As shown in FIG. 3, the basic circuitry 88 includes a metal detector 19 having a transmitter 19*a* and a receiver 19*b*. Metal detector can be a commercially available metal detector. The circuit also includes an amplifier and transistor generally designated 21, which may include an amplifier 21*a* and a Darlington transistor 21*b*. The circuitry 88 also includes a solenoid 6 which can also be a commercially available device and which is used to activate the actuation mechanism. The transmitter 19*a* sends a pulse wave, which is to be received by receiver 19*b*. Upon detection of a metal in the sensor range, the pulse wave is distorted and disrupts the reception at the receiver 19*b*. This sends a small signal to the amplifier 21*a*. The amplifier 21*a* increases the magnitude of the signal so as to activate the transistor 21*b*. The transistor 21*b* acts like a switch for the solenoid 16, which has a separate power source from the metal detector 19. The system thus provides a detection capability, and a system for communicating a detection signal to an actutator.

An example of an alternative to the amplifier and transistor illustrated, would be a relay. However, in such a circuit, the time period that elapses between detection by the detector, and activation of the solenoid, is relatively long, and may not be suitable in some circumstances. It is also possible in some other embodiments to provide for wireless or optical or other communication of the signal from the detector to the actuator.

So, in summary, once the presence of a characteristic of a metallic object 11, more specifically, an anti-personnel land mine, in close proximity to a specific leg 14 is detected, then a deactivation signal is sent through circuitry 88 to the solenoid 16, which actuates the follower 15.

The detector 19 may be configured such that a signal is only sent to the solenoid 16 when the strength of the detection reaches a certain threshold level. A programmable logic controller could be incorporated into the circuitry to control the communication of the signal, for an appropriate level of sensitivity.

Upon receipt of the signal, the follower 15 is driven into the solenoid 16, and releases the lower portion 14*a* of leg 14 such that the lower portion 14*a* "gives way" (ie. that leg is deactivated from load carrying) such that the load on the lower portion 14*a* on the deactivated leg 14 is substantially eliminated. If necessary to substantially eliminate the force on lower leg portion 14*a*, the lower portion can translate upward. Thus, a very small contact force is produced between the deactivated leg 14 and mine 11 or the area in close proximity thereto, and the land mine should not explode. The remaining load applied to mine 11 or the area of the ground near mine 11, when the actuator 45 releases the movement constraint to deactivate a leg, will be maximally the weight of the deactivated leg 14. The remaining activated legs 14 mounted to the plate 13 will handle the additional load transferred from the deactivated leg 14.

Once the leg 14 moves off the mine 99, the signal to the solenoid 16 from the detector ceases. Then the follower 15 returns into its original position, which can be controlled by a spring 13. The follower 15 interacts with a cam profile 14*e* on the leg 14 to be guided to its locking position. The leg 14 freely returns into its initial position through its own weight. Finally, the leg 14 is constrained and locked again by the follower 15, and can be loaded fully to transmit load from plate 13, through joint 12 to the terrain 97.

It should be noted that it is not normally preferred to employ a bi-directionally driven follower 15 which will try to force the follower back to the locked or engaged position.

Figure 2C:
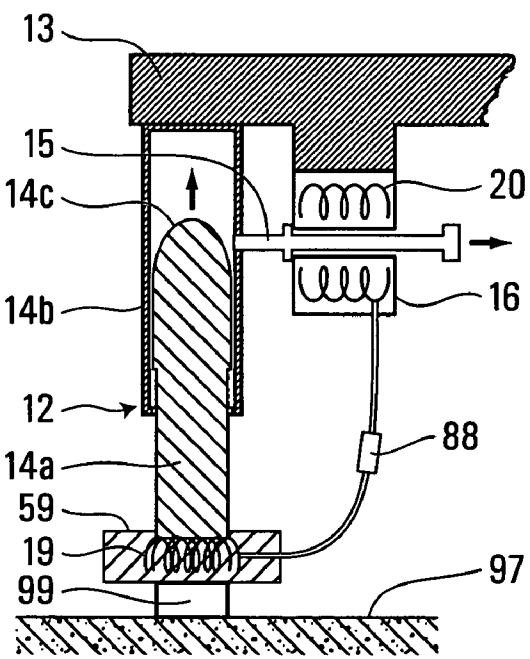
FIGS. 2*a*, 2*b* and 2*c* are cross-sectional side views of the embodiment of FIG. 1*b* showing the sequential movements of a support leg during operation.
Figure 2B:
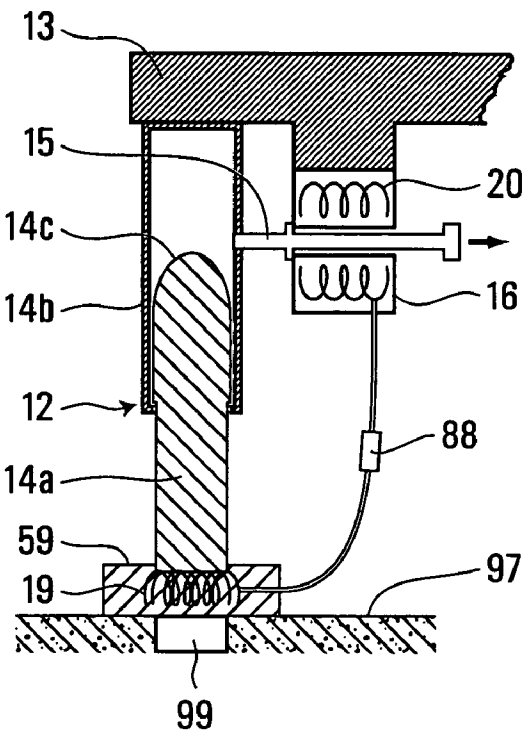
Figure 2A:
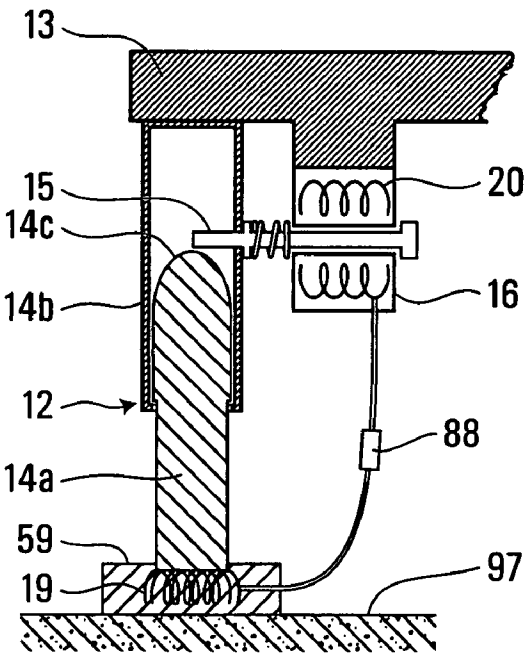

With reference to FIGS. 2*a* to 2*c* the actuation and release sequence of a leg 14 is illustrated. As shown in FIG. 2*a*, the leg 14 to be deactivated is in contact with non-metallic ground 155. As the mine shoe 10 moves, the leg 14 eventually comes into close proximity with an object 99, such as a mine which is detected. As shown in FIGS. 2*b* and 2*c*, due to the signal received from the detector 19, the follower 15 of the solenoid is retracted (see arrow) and the leg 14 is released/deactivated such that is can no longer transmit a load from plate 13 to terrain 97. If the detected object 99 is buried in the ground 15, then the leg 14 itself does not move (FIG. 2*b*). If the object 99 is above the ground 155 as shown in FIG. 2*c* (e.g., the trigger of a landmine), then the leg 14 will move, by translating upwards (see arrow in FIG. 2*c*), as it is no longer constrained by the follower 15. It will be appreciated that the detection off the object, and the sending of the signal to the actuator 45, will have to occur very quickly. This is particularly the case if the mine device (e.g. trigger) is above ground and the leg 14 to be deactivated actually comes into close proximity with the mine, to ensure that the leg is deactivated quickly enough before a significant load is transferred to the mine.

Although the detectors such as metal detector 19, will typically be configured to detect the presence of metal before the leg or leg plate makes contact with the metal, due to a specific detection range, there are still design requirements relating to the time period that elapses between detection and the actuation device operating to deactivated a leg. Release speed and the permissible time period can be varied by for example: increasing the detection range of the detector, reducing the travel (displacement) of the actuator parts, and instructing the user of the device to avoid quick movements. In example embodiments intended to be used in civilian demining, which does not require fast movements, the time span between detection and final release of a leg was 1/30 s, which was acceptable.

Actuator 45 is configured so that once detector 19 no longer detects the presence of a mine 99, and the deactivated leg 14 is no longer in a dangerous position, then the leg will eventually return to its fully extended position (e.g. through its own weight) and the follower 15 will return to its original position through a spring, The follower 15 will follow the cam profile 14*e* of the end of lower leg portion 14*a* until it reaches the original locked position of FIG. 2*a*.

Figure 1C:
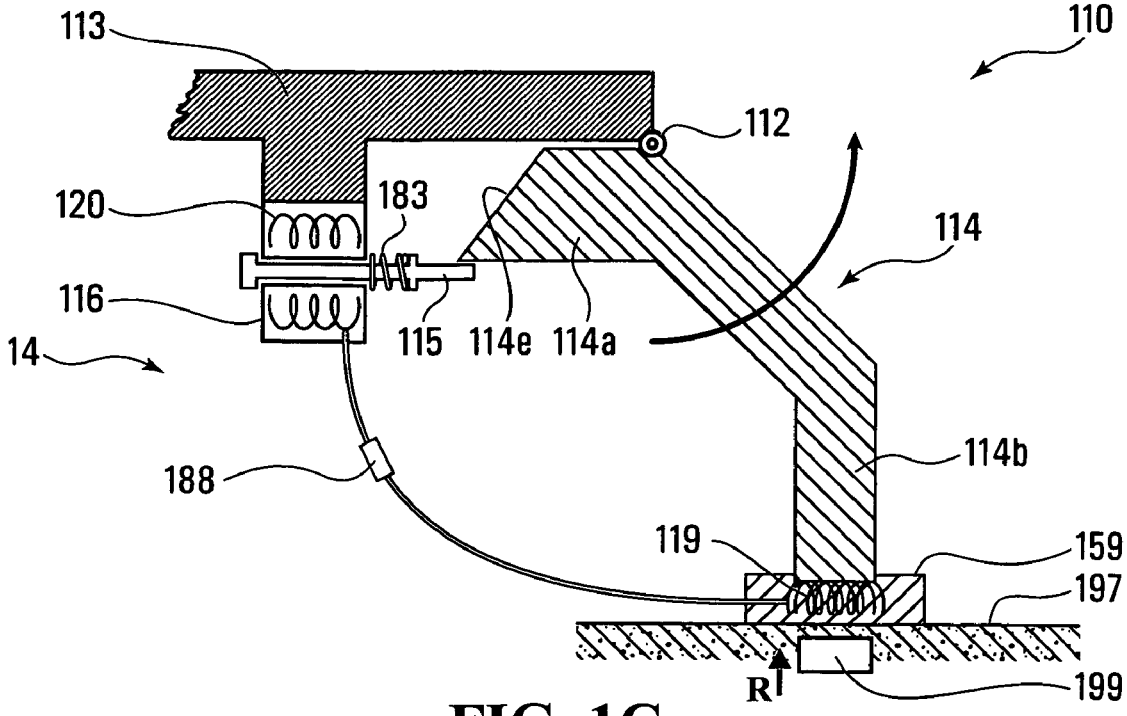
FIG. 1*c* is a cross-sectional side-view and cross-section of part of an alternate mine shoe in accordance with another embodiment of the invention.

With reference now to FIG. 1*c*, a part of a mine avoidance device (e.g. mine shoe) 110 is shown in a cross sectional side view. The mine shoe portion in FIG. 1*c* is quite similar to the mine shoe portions that make up mine shoe 110 in FIG. 1*a*. However, in FIG. 1*c*, a support leg 114 is shown to have a revolute joint mechanism whereby a support leg 114 having opposite arms 114*a* and 114*b*, is capable of rotational motion with respect to upper plate 113 about a pivot 112. The support legs 114 of the mine shoe can all rotate about a pivot 112 with respect to the plate 113, when the movement is unconstrained by an actuator such as actuator 145. However, this motion is normally constrained by an actuator 145. When movement is constrained, the legs 114 can resist moments that result from ground reaction forces applied to the legs 114. Thus, when constrained, the legs 114 can support the load applied to the plate 113 by the person wearing the mine shoe.

However, when the actuator 145 receives a signal from detector 119 through circuitry 188, the actuator 145 releases a leg 114, then the leg 114 is capable of rotating in the direction shown by the arrow in FIG. 1*c*, when an anti-clockwise moment is applied by the reaction ground force about pivot 112. When an upwardly directed ground reaction force is applied to the bottom end of lower end portion of leg 114, it will be appreciated that this reaction normal force R will create a counter-clockwise moment about pivot 112, which if unrestrained would cause the leg 114 to rotate counter clockwise about pivot 112. However, in normal conditions (ie. when no mine has been detected), the rotational motion of the leg 114 is constrained by actuator 145.

As shown in FIG. 1*c*, actuator 145 includes a core (follower) 115 of a solenoid 116 mounted to the plate 113. The follower 115 when in an extended position shown in FIG. 1*c*, engages part of the end of leg arm 114*a*, and so holds the arm 114*a* and thus leg 114, from rotational movement. Follower 115 can engage an outer, under surface of arm 114*a* or in another example embodiment, be received in an aperture in the wall of arm 114*a*. Thus follower 115 can, when engaged, constrain the rotational movement of leg 114 about pivot 112.

Each support leg 114 can be provided with a detector 119 located at the ground surface 210 of the leg 114. Like detector 19 described above, detector 119 may be a metal detector device or other detector. It will be appreciated that if each of support legs 114 has a separate detection capability associated therewith so that the presence of a mine 199 in the close proximity of each leg can be identified. With separate detection capability, each support leg 114 can be deactivated and activated independently of the others. It may be possible however to have a single detection device/system, which can provide separate detection capability for each support leg 114.

The detector 119 associated with each support leg 114 is in communication with the respective actuator 145 associated with that leg 114. This communication may be facilitated by electrical circuitry such as is illustrated in FIG. 3, as described above.

Once the presence of a object 199, more specifically, an anti-personnel land mine, in close proximity to a specific leg 114 is detected, then a deactivation signal is sent through circuitry to the solenoid 116, which actuates the follower 115. The detector 119 may be configured such that a signal is only sent to the solenoid 116 when the strength of the detection reaches a certain threshold level. As with the previous embodiment of FIG. 1*b*, a programmable logic controller could be incorporated into the circuitry to control the sending of the deactivation signal for an appropriate level of sensitivity with respect to the sending of the signal to the actuator.

Upon receipt of the deactivation signal, the follower 115 slides into the solenoid 116, and releases the lower leg 114 such that the leg 114 is deactivated from resisting counter clockwise moments applied to the leg 114 from ground reaction forces, such that the resisting moment acting in a clockwise direction about pivot 112 on the deactivated leg 14 is substantially eliminated. Thus, a very small contact force is produced between the deactivated leg 114 and mine 299 or the area in close proximity thereto, and the land mine should not explode. The remaining load applied to mine 199 or the area of the ground near mine 199, when the actuator 145 releases the movement constraint, will at a maximum only be the result of the weight of leg 114, which can be chosen to be relatively low. The remaining activated legs 114 mounted to the plate 113 will handle the additional load transferred from the deactivated leg 114.

Once the leg 114 moves off or away from the object 199, the signal to the solenoid 116 ceases, and then the follower 115 returns into its original position, controlled by a spring 113. The leg 114 can freely return into its initial position through its own weight, whereby the follower 115 again engages arm 114*a* of leg 114. The leg 114 is thus constrained and locked again by the follower 115, and can again transmit load from plate 113 to the terrain 197.

Figure 2E:
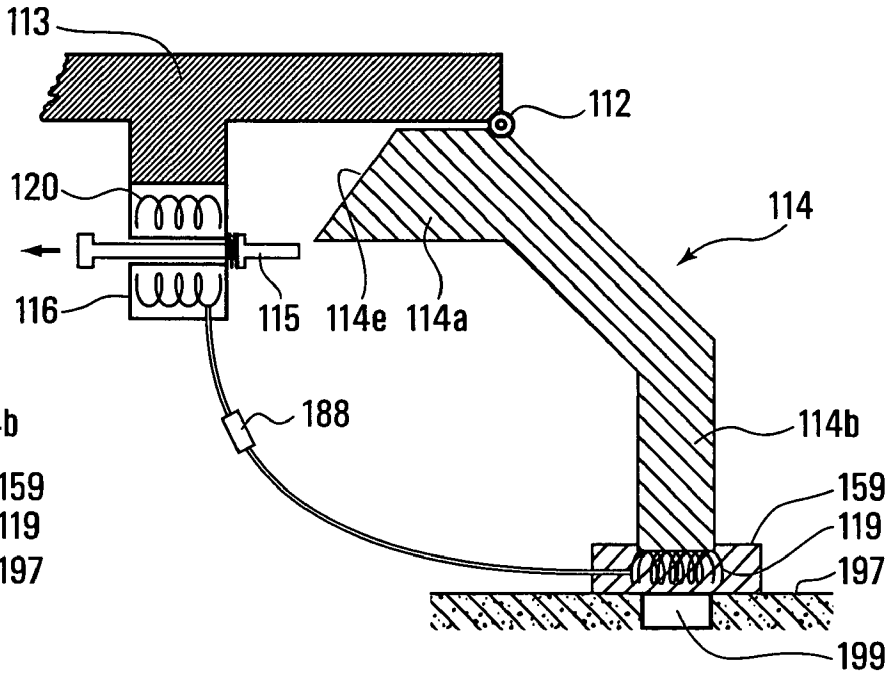
FIGS. 2*d*, 2*e*, 2*f*, and 2*g* are cross-sectional side views of the embodiment of FIG. 1*c* showing the sequential movements of a support leg during operation.
Figure 2D:
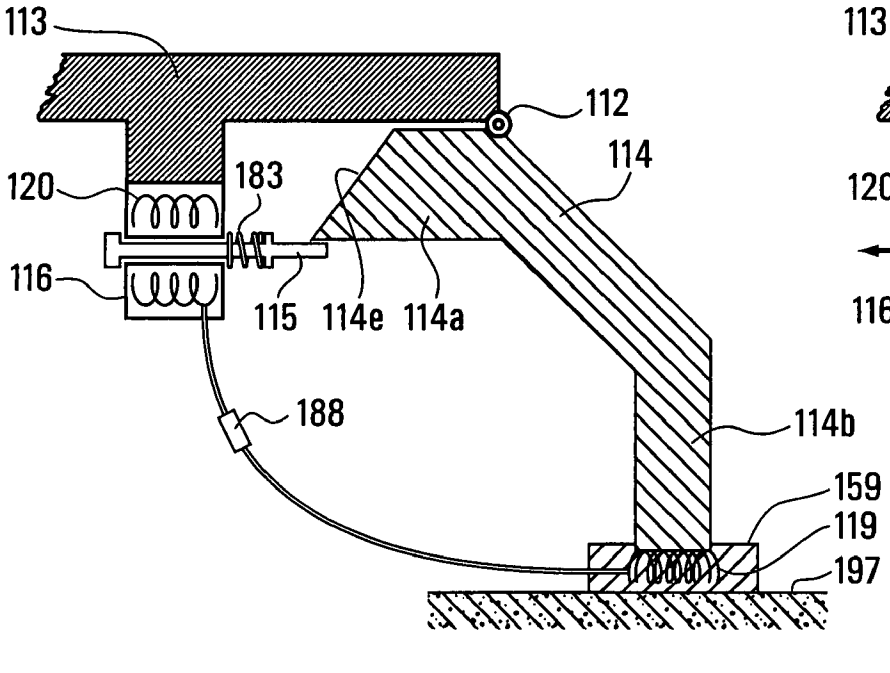
Figure 2G:
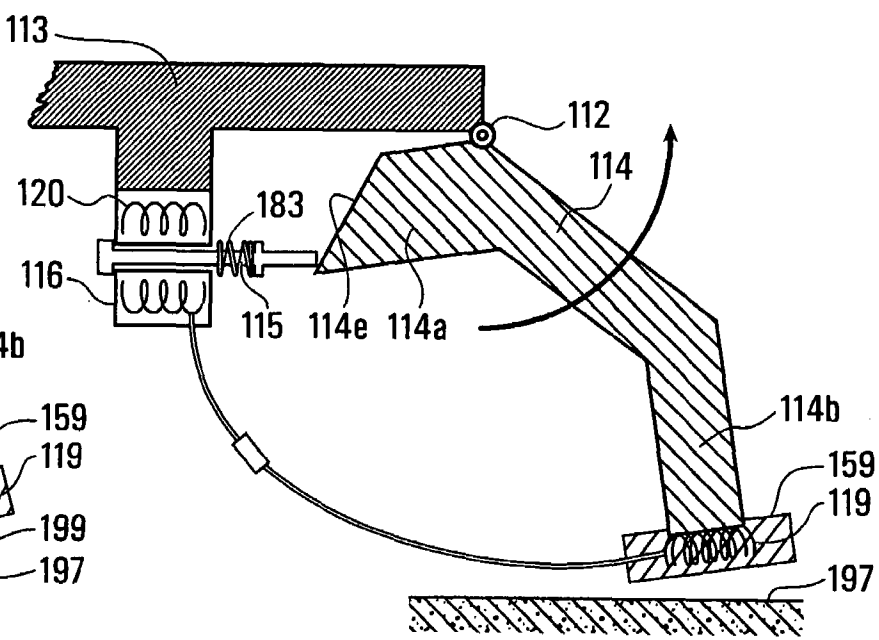
Figure 2F:
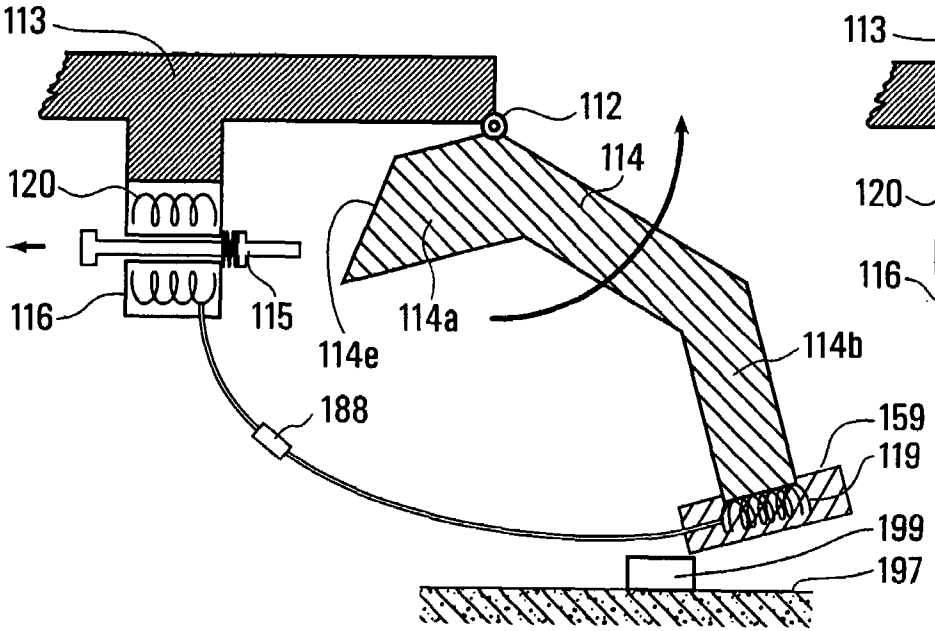

With reference to FIGS. 2*d* to 2*g*, the actuation and release sequence of a leg 114 is illustrated. As shown in FIG. 2*d*, the leg 114 to be deactivated is in contact ground 197 having no mine present. As the mine shoe 110 moves, the leg 114 eventually comes into contact or other close proximity with an object, specifically a mine 199. As shown in FIGS. 2*e* and 2*f*, due to the deactivation signal received from the detector 119, the follower 115 of the solenoid is retracted (see arrow) and the leg 114 is released/deactivated such that is cannot resist counter clockwise moments applied thereto, as a result of reaction ground forces. If the detected object 199 is buried in the ground 115, then the leg 114 itself will typically not move (if the ground is level) (FIG. 2*e*). If the detected object 199 is above the ground 155 as shown in FIG. 2*f* (e.g., the trigger of a landmine), then the leg 114 itself rotates (arrow) as it passively moves because of its inability to exert a load on the object 199. As discussed above, it will be appreciated that the detection and sending of the deactivation signal to the actuator 145 occurs very quickly, particularly if the mine device (e.g. trigger) is above ground and the leg 114 to be deactivated actually comes into contact with the mine. This will ensure that the leg is deactivated before a significant load is transferred to the mine.

Actuator 145 is configured so that once detector 119 no longer detects the presence of a mine 199, the deactivated leg 114 is no longer in a dangerous position, then the leg 114 will eventually return to its fully rotated position (through its own weight) and the follower 115 will return to its original position through spring 113. The follower 115 will return to a contact position after having been pushed back as it engages the cam profile 114*e* of arm 114*a* and is slightly pushed back until it the arm is in its original position and the follower than reaches the original locked position of FIG. 2*d*.

The basic principle behind the mine shoes described above is providing legs which when they come into close proximity with a mine, have a constrained movement that is released such that virtually no load is applied by the deactivated leg to the mine. In other embodiments, a secondary actuation functionality can be provided so that in addition to releasing the constrained movement, the deactivated leg has its movement actually driven by a drive mechanism. In such embodiments, the detector inside each leg may be configured to send a signal through a circuit to a second actuator, upon detection of a mine. The primary actuator releases the leg such that it can move at the joint as described above. The second actuator additionally supports the motion of the deactivated leg, and actively drives the leg away from the mine. This ensures that the leg is forced away from close proximity with the object. Thus no force is applied to the object, and the landmine is not activated.

In the first embodiment, a hydraulic or pneumatic cylinder could be provided as a secondary actuator to drive the lower leg portion 114*a* in the direction of arrow. In the embodiment of FIG. 1*c*, a second actuator might be a revolute motor, e.g., an electric motor, configured so the axis of the revolute motor, or the axis of one of the gearwheels driven by the revolute motor, constitutes the revolute joint of the leg.

The secondary actuator could also be configured so that once the leg moves away from the mine, such that the detector does not detect it anymore, then the second actuator can be activated again, this time in the reverse direction, and moves the leg actively back into to its initial position. Alternatively the secondary actuator could be disengaged so that the deactivated leg returns passively through its own weight to its initial load bearing position, such that the leg can again be loaded and transmits ground reaction forces to the plate.

It would also be possible to provide a mine shoe, which combines both a prismatic joint and a revolute joint for each support leg. Deactivation of the leg by means of an actuator like actuator 45 or 145 could then release the leg for both linear as well as rotational movement. Alternatively, two actuators, one like actuator 45 the other like actuator 145, could be provided to constrain linear and rotational movement respectively. A programmable logic controller may be configured to respond to a signal from a detector to make a determination of whether one or both of actuator 45 and/or actuator 145 should be triggered to deactivate the leg for linear and/or rotational movement.

Figure 4A:
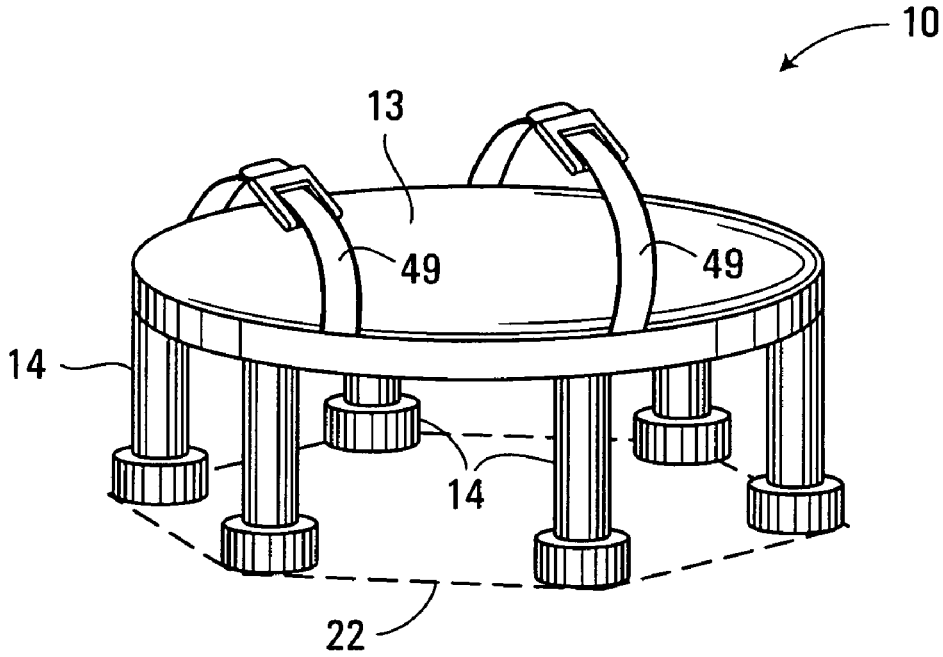
FIG. 4*a* is a perspective view of the entire mine shoe of FIG. 1*a* in a full support state.
Figure 4B:
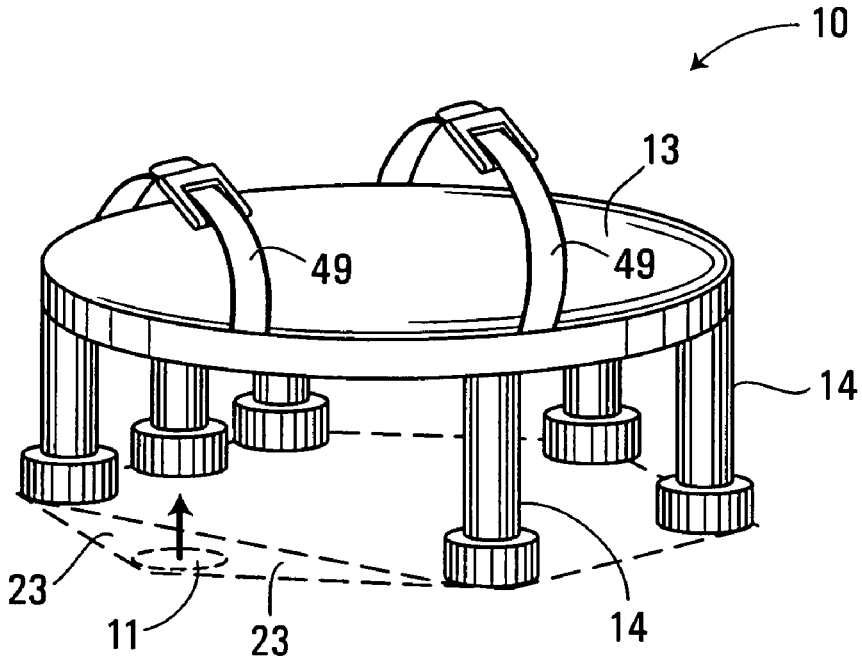
FIG. 4*b* is a perspective view of the entire mine shoe of FIG. 1*a* in a mine detection support state.
Figure 4C:
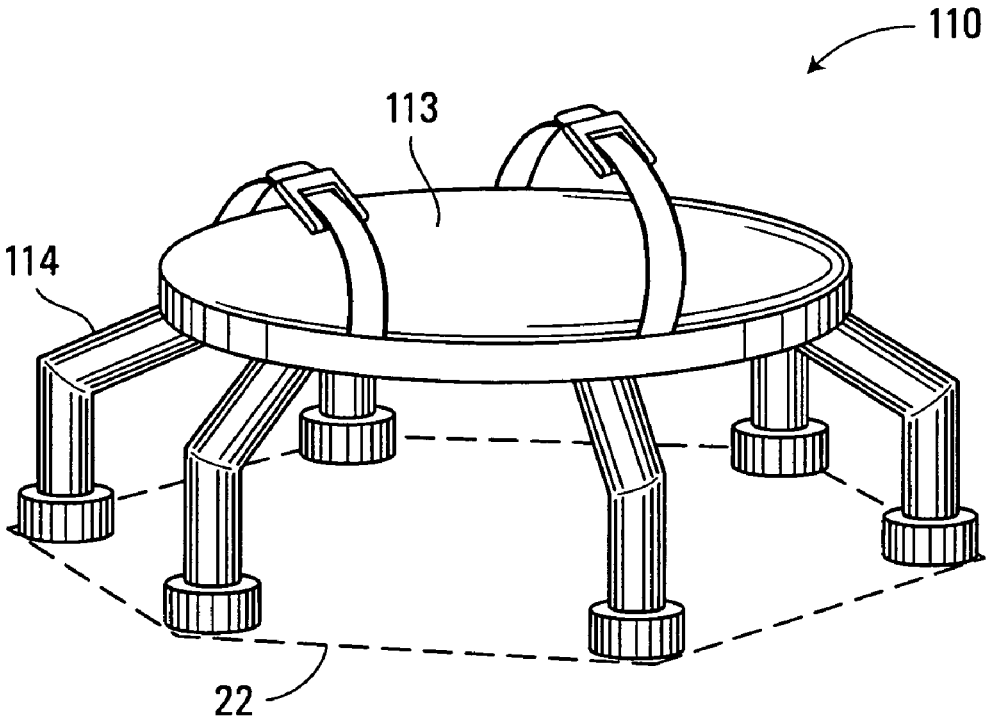
FIG. 4*c* is a perspective view of the entire mine shoe of FIG. 1*c* in a full support state.
Figure 4D:
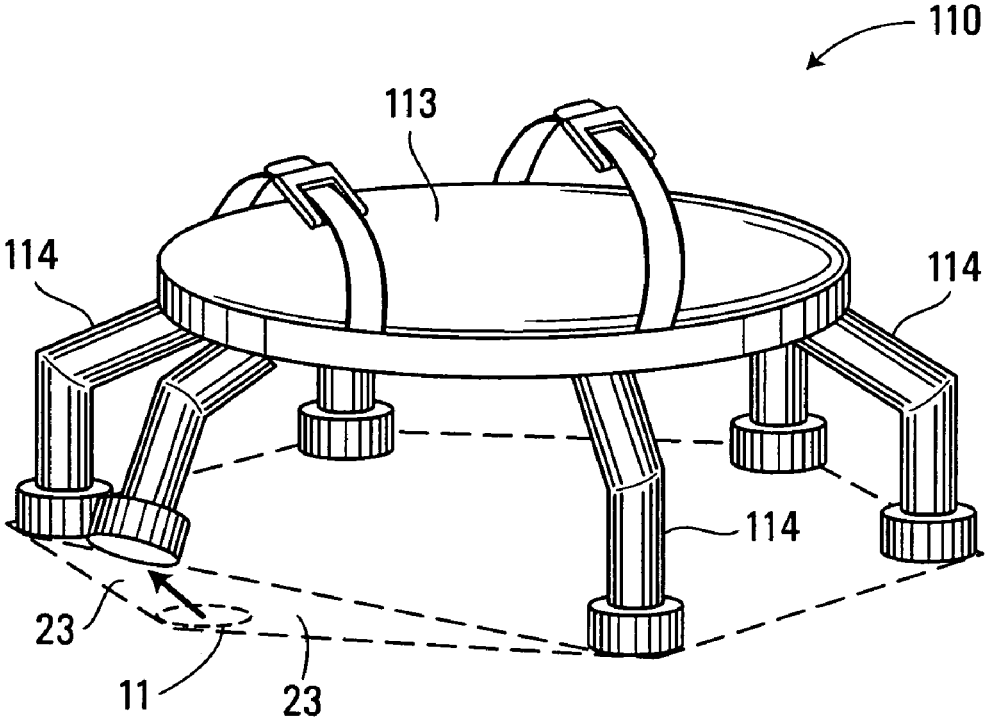
FIG. 4*d* is a perspective view of the entire mine shoe of FIG. 1*c* in a mine detection support state.

Referring to FIGS. 4*a* and 4*d*, the mine shoe, consists of the plate 3, 13 and in most embodiments would have at least three legs 14, 114, preferably six legs. However, it might be possible to deploy a mine shoe that only has two support legs, bearing in mind that a person will typically be wearing two mine shoes. The legs might be configured with a wide contact pad at its bottom to enhance stability. Thus, it may be possible for a person to remain standing with a mine shoe on each foot, even if only one mine shoe is supported on one leg. This would however be relatively unstable and so would not be a desirable configuration.

In the embodiments described above, once a leg 14 or 114 comes into close proximity with a mine, then the movement constraint is released and that leg can no longer transmit forces from the plate to the terrain. Thus, the deactivated leg 14, 114 can no longer contribute to the support area 22 of the mine shoe and a part 23 of the entire support area 22 gets lost. The minimal loss of area per number of legs upon release of one leg in a mine shoe, with an even number of legs, results from a design solution with six legs.

For a regular polygon with n corners and corner-centre distance r, the area lost $A_L$ if one leg is released is:

$$A_L=4r^2\sin^3(\pi/n)\cos(\pi/n) \quad (1)$$

The relative remaining area $A_R$ is:

$$A_R=1-A_L/A_0=(n-4\sin^2(\pi/n))/n \quad (2)$$

The ratio R of relative remaining area $A_R$ per leg is:

$$R=A_R/n=(n-4\sin^2(\pi/n))/n^2 \quad (3)$$

The maximal ratio R for an even number of legs results from six legs.

For equilibrium of a rigid body, it is necessary that the sum of the external forces and the sum of the external moments, about each of three orthogonal axes equals zero.

Thus, it will be appreciated that when one leg is deactivated, the remaining legs have to be able to support the plate and the external load applied thereto. As the loads applied to the plate by each remaining leg to compensate for the external load applied by the person's foot, are redistributed, it will also be necessary for there to be compensation to ensure that the moments are maintained at zero. While in many embodiments, this can be handled by the appropriate loads being applied by the remaining legs, in other embodiments, a momentum imbalance may be compensated for by the ankle joint muscles of the person using the plate.

Figure 5A:
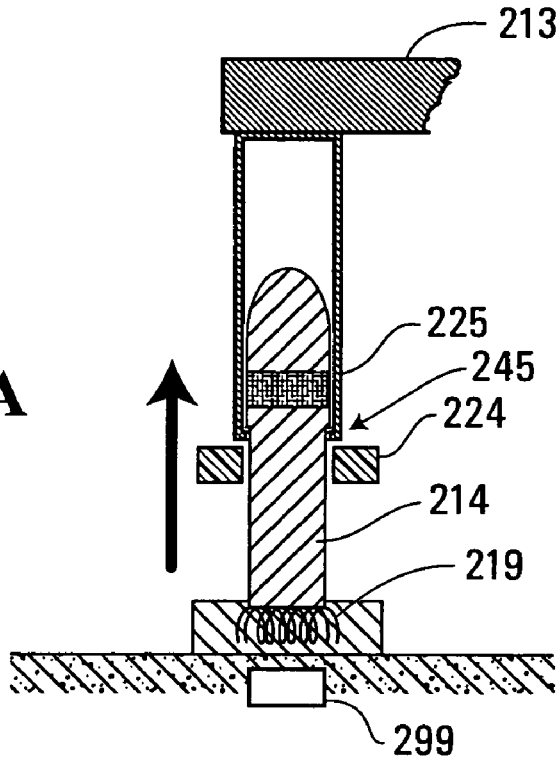
FIG. 5*a* is a cross-sectional side-view and cross-section of part of another alternate mine shoe in accordance with yet another embodiment of the invention.
Figure 5B:
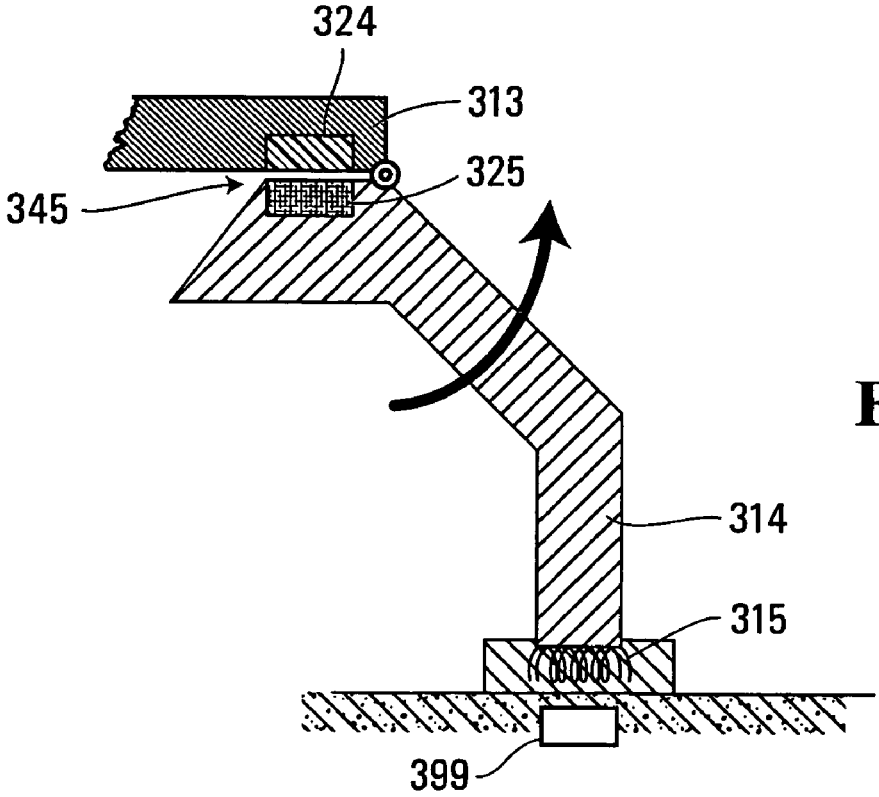
FIG. 5*b* is a cross-sectional side-view and cross-section of part of another alternate mine shoe in accordance with yet another embodiment of the invention.

Referring to FIGS. 5*a* and 5*b*, further actuator devices are illustrated for releasing a support leg 4 mounted to a plate like plates 13, 113.

As already shown in FIGS. 1*b* and 1*c*, a solenoid 16,116 actuates a follower 15,115. In the embodiments of FIGS. 5*a* and 5*b*, the plate and support leg mechanism is substantially the same as the embodiments of FIGS. 1*b* and 1*c*, with legs 214,314 mounted for linear/rotational movement in relation to plates 213, 313 respectively. The actuators 245, 345 however comprise the interaction between an electromagnet 224, 324 and a ferromagnetic material 225, 325 such as by way of example only, iron, nickel, cobalt, rare-earth magnets, alloys of the aforementioned metals and Heusler alloys. Other combinations of magnets and magnetic materials can be employed to provide for a suitable magnetic constraining force/moment which can be released when an appropriate signal is provided thereto. The electromagnets 224, 324 are powered until the leg 214, 314 comes into close proximity with a mine 210,310.

Referring to FIGS. 5*a* and 5*b*, leg 214 is constrained by an electromagnet 224, e.g., solenoid, which is switched off, and thus releases the leg 214 upon coming into close proximity with a mine 299, 399. In these embodiments, the actuator 216,316 is powered if the leg 214, 314 is not in close proximity with a mine. Parts of the leg 214, 314 contain a ferromagnetic material 225, 325, which results in a magnetic force interaction with the electromagnet 224, 324 if the leg 214, 314 is not close proximity with a mine 299, 399.

Referring to FIG. 6, the distal end of a support leg 4 and its ground surface 10 can comprise further elements.

Figure 6A:
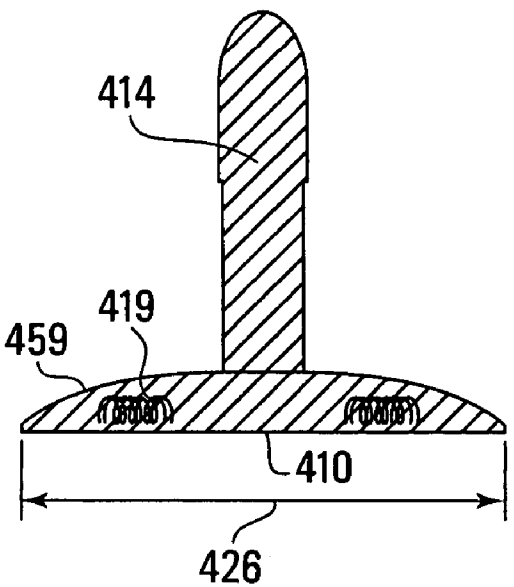
FIG. 6*a* shows another embodiment of a support leg.
Figure 6B:
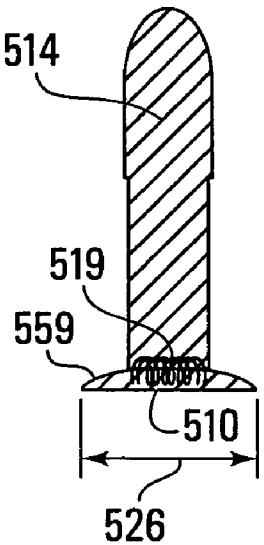
FIG. 6*b* shows a leg with a smaller ground contact area.

Referring to FIGS. 6*a* and 6*b*, the ground surface contact areas 410 and 510 for support pads 459, 559 respectively, are different in size. In each case, the distal end of the leg 414, 514 is provided with detectors 419, 519 such that the detection area 426, 526 of the detector 419, 519 is slightly larger than the ground surface area 410, 510 beneath the distal end of the leg. It is important, that the individual detection areas not overlap, but must be larger than the ground contact area of a leg (ground plate).

Figure 6C:
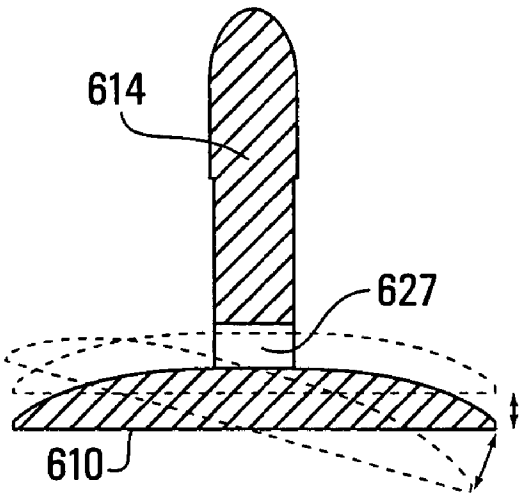
FIG. 6*c* shows a leg with a flexible elastic insert.

Referring to FIG. 6*c*, the distal end of leg 4 comprises flexible elements 627, are interposed between the leg 114 and the support pad 659 which account for damping and adjustment (arrows) of the ground surface 610 to help provide level support of the plate on uneven ground. Flexible elements might comprise by say of example only springs (e.g. wave springs and Belleville washers), rubber (e.g., silicone rubber, air cushions and fluid chambers with flexible walls or bellows design, and combinations thereof. The flexible elements can be mounted between the leg and support pad by known methods such as by force fitting, screws, bolts, glue, etc.

Elements 627 might also provide for elastic, resilient displacement from a generally perpendicular orientation of the lower pad surface relative to the longitudinal axis of the leg, or from a position when the support pad sits on level terrain. Resilient elements 627 might comprise, by way of example only, springs (e.g. wave springs and Belleville washers), rubber (e.g., silicone rubber, air cushions and fluid chambers with flexible walls or bellows design, and combinations. They could be mounted in the same way as flexible elements.

Figure 7:
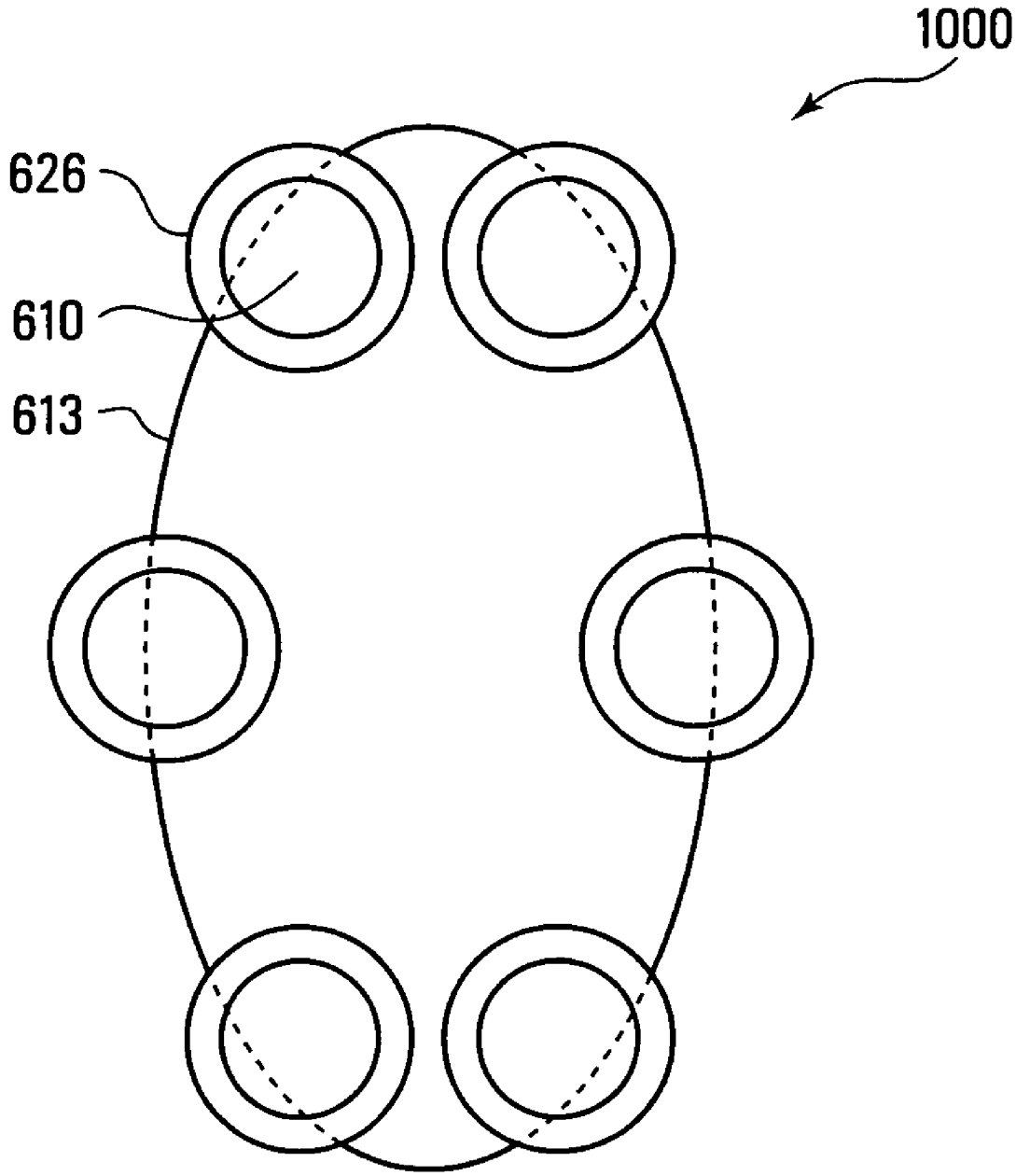
FIG. 7 shows the ground surfaces of six legs in top view.

Referring to FIG. 7, the footprint of a mine avoidance and protection device 1000, which can be constructed like the devices described above is shown. The sensor areas 626 of the detectors (not shown) are slightly larger than the ground surface contact areas 610 of each support plate (not shown). Furthermore, the sensor areas 626 are separated from each other so that they do not overlap. This diminishes the chances of more than one leg being deactivated at the same time. Preferably, a mine will deactivate only one leg at a time.

Referring to FIG. 8, another embodiment is illustrated schematically in which a foot plate 713 is configured in a generally rectangular shape. Secured to foot plate 713 are six legs 714 having support plates or pads 759. Possible positions of a mine 799 are shown in relation to legs 714 and plates 759, in each case only one leg 714 will be deactivated. The sensor areas that are associated with each of the legs is selected such that sensor areas will not overlap, and thus two legs will not be deactivated at the same time.

With reference to determining the optimal number of legs that can be employed:

Relative area lost if one leg is deactivated: $1/(n-2)$

Relative remaining area if one leg is deactivated: $1-1/(n-2)$

Relative remaining area per leg ratio: $(1-1/(n-2))/n=(n-3)/(n(n-2))$

Best ratios are with 4 and 6 legs; 6 is desirable, as the relative lost area is smaller than with a 4-leg design.

Figure 9:
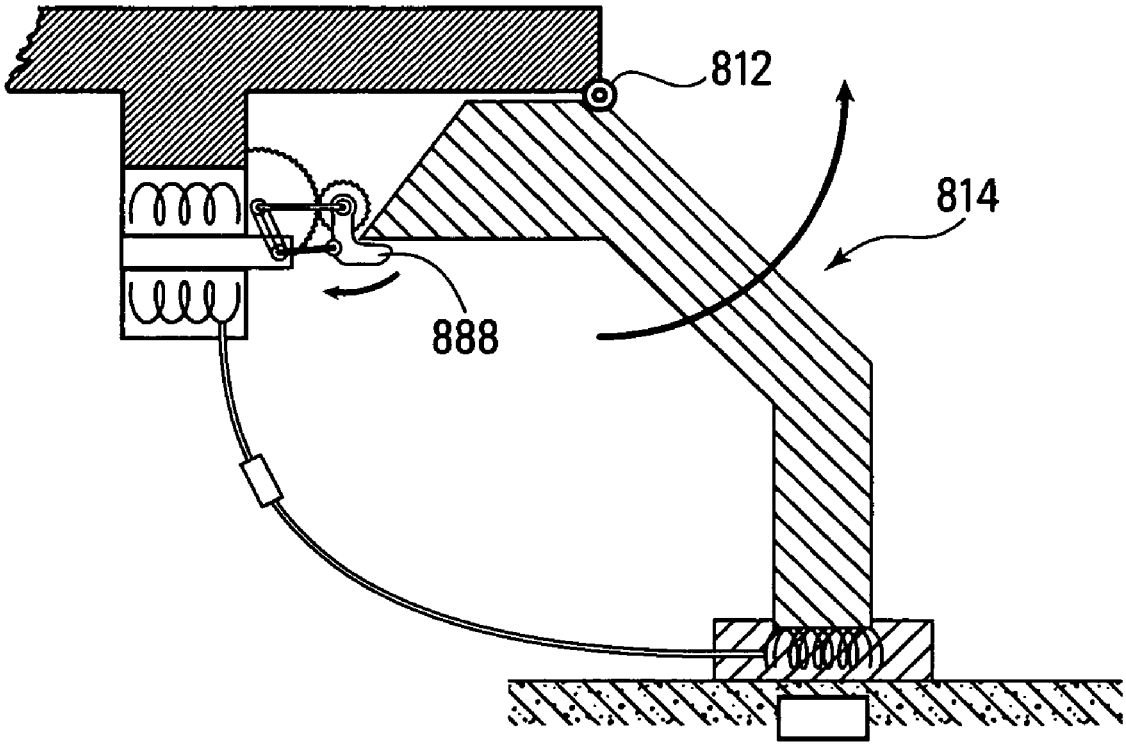
FIG. 9 is a side elevation view of an example alternate actuation mechanism.

While several embodiments have been described herein and illustrated in the drawings, other embodiments are of course possible. By way of further example only, the movement of support legs can also be constrained by any other actuation mechanisms. For example, a hook which is actuated by a actuator, preferably by a unidirectional one, can be configured to release the leg by swinging backwards out of engagement with the support leg. An example of a hook implementation is shown schematically in FIG. 9, in which a leg 814 can rotate about a pivot 812, and is constrained by a hook 888. The hook may be actuated for example by a linear actuator, e.g., solenoid, through a linkage, e.g., a crank-slider or by a revolute motor directly or through a four-bar linkage or gears, all of which are shown schematically as different possible configurations in FIG. 9. The hook, in these embodiments, is the revolute counterpart to the linearly sliding core of a solenoid. The hook can be referred to as a revolute constraint, and the core as a linear constraint.

In other example embodiments, the mine detection through the detector can additionally be enhanced by a visual signal, e.g., by an LED, and/or by an acoustic signal, e.g. via earphones, in order to provide a warning signal to the wearer of the mine shoe and/or others for de-mining purposes.

When a person uses mine shoes such as those described above, if they step on or close to a mine, the prospects of the mine exploding is significantly diminished, as the force applied should be limited to the weight of the support leg that is in close proximity with the mine.

Additionally, if the mine does explode, the mine shoe will provide some level of blast effect attenuation, due to the raised design of the plate, and in some embodiments the strength of material making up the plate, and the size of the plate. The raised design is due to the mine shoe's legs, which cannot be released if the distance between the plate and the ground is too small. A hollow plate, providing a thicker plate for a given weight of mine shoe, can add to blast absorption and attenuation capability of the mine shoe and can house the circuits.

Such devices may be used on terrain other than the ground in an outdoor environment.

The invention may be used by both military and civilian personnel, including during de-mining operations. Military personnel can also use the device during military operation. Devices might also be employed on robotic systems or on military vehicles. Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

What is claimed is:

1. A mine device comprising a frame adapted to be secured to a source of a load;

at least three support legs each extending from said frame for supporting said frame in spaced relation to a terrain, each said leg having a releasable joint between said leg and said frame;

at least one detector operable to provide a detection capability for each support leg, each said detection capability operable to detect a characteristic of a mine when at least a portion of said support leg is located proximate to said mine;

at least one actuator operable to provide an actuation capability at said joint of each said leg, said at least one actuator operable to: (a) constrain the joint to allow a load to be transmitted from said frame, through said joint and said support leg to said terrain; and (b) to release said joint such that a load can not be transmitted from said frame through said joint and said support leg to said terrain;

said at least one actuator operable in response to a signal received from said at least one detector indicating the detection of said characteristic at a first leg of said support legs, to release each said joint associated with said first support leg;

said at least one detector being in communication with said at least one actuator device, so as to be able to provide said signal from said at least one detector associated with each said detection capability to said at least one actuator associated with the corresponding actuation capability;

whereby when said characteristic is detected proximate to a support leg, said at least one detector communicates with said at least one actuator to cause the actuator to release the constraint at the joint associated with that support leg.

2. A device according to claim 1, wherein said at least three legs comprises six legs.

3. A device as claimed in claim 2 wherein the detection capabilities for each support leg are separated from each other.

4. A device as claimed in claim 3 wherein said frame comprises a plate.

5. A device as claimed in claim 1 wherein the detection capabilities for each support leg are separated from each other.

6. A device according to claim 5, wherein the joint between the frame and each leg is a one degree-of-freedom prismatic joint.

7. A device according to claim 5, wherein the joint between the frame and each leg is a one degree-of-freedom revolute joint.

8. A device as claimed in claim 5 wherein said at least one actuator comprises a separate actuator associated with each joint of each support leg and wherein each separate actuator comprises a linear actuator.

9. A device as claimed in claim 8 wherein said linear actuator is a solenoid having a follower for engaging and disengaging from said leg.

10. A device according to claim 1, wherein said at least one actuator comprises a separate actuator associated with each joint of each support leg.

11. A device as claimed in claim 10 wherein each separate actuator comprises a linear actuator.

12. A device as claimed in claim 11 wherein said linear actuator is a solenoid having a reciprocating follower for engaging and disengaging said leg.

13. A device as claimed in claim 10 wherein each separate actuator comprises a revolute actuator.

14. Device according to claim 10, whereby each separate actuator comprises an electromagnet at the plate, which is in contact with a ferromagnetic part of the leg and constrains the motion of the leg through generating a magnetic force, said magnetic force being disengaged upon receiving said signal.

15. A device according to claim 1, further comprising a secondary actuator for driving a support leg away from said terrain when said at least one actuator releases the joint associated with said support leg.

16. A device according to claim 1, whereby each of said support legs comprises a support pad mounted proximate to a distal end of each said leg, for contacting said terrain.

17. A device according to claim 16 further comprising flexible elements interconnected between said leg and said support pad providing adjustment of the support pad relative to the leg to more easily accommodate uneven ground.

18. A device as claimed in claim 17 further comprising elastic elements to provide for a dampening effect between said leg and said support pad.

19. A device as claimed in claim 1 wherein said characteristic is the presence of a metal material.

20. A device as claimed in claim 1 wherein said characteristic is the presence of a plastic material.

21. A device as claimed in claim 20 wherein the detection capabilities for each support leg are separated from each other.

22. A device comprising:

a plate having a lower surface area and being adapted to be secured to an appendage of a human being;

at least three support legs each extending below the lower surface of said plate, for supporting said plate on terrain, each said leg having a distal end for engaging the terrain, each said leg movable in at least one degree of freedom relative to said plate at a joint when a ground reaction force is applied to said leg when said leg is not constrained;

a detector system providing a detection capability associated with each said leg, said detection capability for detecting a characteristic of a mine when at least a portion of said leg is located proximate to said mine;

an actuator device associated with each leg, operable to release the leg portion to allow movement in said at least one degree of freedom such that no load can be transmitted from said plate through said joint and said leg to said terrain, each said actuator operable in response to a signal received from said detection system associated with each said leg;

said detection associated with each said leg, being in communication with said actuator device associated with the respective leg and operable to activate said actuator;

whereby when said characteristic is detected by said detector, said detector system communicates with said actuator to cause the actuator to release the constraint and to allow the leg to move, at/about the joint, with respect to the plate once a metallic object is detected by the metal detector, such that the leg exerts a zero-force to the metallic object.

23. A method of avoiding the activation of a mine comprising:

supporting a load with at least three support legs each in a constrained mode, each said leg having a constrained mode wherein said support leg participates in supporting said load on said terrain, and an unconstrained mode, wherein said leg does not participate in supporting said load on said terrain;

detecting a characteristic of a mine when at least a portion of one of said three support legs is located proximate to said mine;

in response to said detecting, sending a signal to an actuator;

in response to said signal, transferring said one leg from said constrained mode to said unconstrained mode with said actuator such that said one leg no longer participates in supporting said load on said terrain.

24. A device for avoiding the activation of a mine comprising:

a base for supporting a load with at least three support legs secured to said base, each said leg having a constrained mode wherein said support leg participates in supporting said load on said terrain, and an unconstrained mode, wherein said leg does not participate in supporting said load on said terrain;

a detector system having a capability associated with each support leg for detecting a characteristic of a mine when at least a portion the respective support legs is located proximate to said mine;

an actuation system having a capability associated with each support leg for transferring each support leg independently or the other support legs, from a constrained mode to an unconstrained mode;

a communication system operable to send a signal to said actuation system in response to the detection of said characteristic;

said actuation system, in response to receiving said signal from said communication system in relation to the detection of said characteristic in association with one of said three support legs, transferring said one leg from said constrained mode to said unconstrained mode such that said one leg no longer participates in supporting said load on said terrain.

25. A device as claimed in claim 24 wherein the detection capabilities for each support leg are separated from each other.

* * * * *